United States Patent [19]

Schmidt

[11] Patent Number: 4,590,977

[45] Date of Patent: May 27, 1986

[54] APPARATUS FOR METERING BULK MATERIAL

[75] Inventor: Edi Schmidt, Unterstammheim, Switzerland

[73] Assignee: SIG Schweizerische Industrie-Gesellschaft, Neuhausen am Rheinfall, Switzerland

[21] Appl. No.: 714,014

[22] Filed: Mar. 19, 1985

[30] Foreign Application Priority Data

Mar. 30, 1984 [CH] Switzerland ..... 1633/84

[51] Int. Cl.[4] ..... B65B 1/12

[52] U.S. Cl. ..... 141/129; 222/53; 222/152

[58] Field of Search ..... 222/53, 152, 408, 411, 222/413; 141/129

[56] References Cited

U.S. PATENT DOCUMENTS

| | | | |
|---|---|---|---|
| 428,346 | 5/1890 | Mueller | 222/413 X |
| 609,861 | 8/1898 | Williamson | 222/413 X |
| 1,505,188 | 8/1924 | Burns et al. | 222/413 X |
| 2,049,331 | 7/1936 | Smith | 222/413 X |
| 2,260,302 | 10/1941 | Driscoll et al. | 222/413 |
| 2,694,509 | 11/1954 | Vita | 222/413 X |
| 2,800,252 | 7/1957 | Wahl | 222/413 X |
| 3,093,271 | 6/1963 | Douglas | 222/413 |
| 3,115,276 | 12/1963 | Johanningmeier | 222/413 X |
| 3,252,630 | 5/1966 | Berg | 222/413 X |
| 3,616,968 | 11/1971 | James et al. | 222/413 X |
| 3,756,434 | 9/1973 | Teske | 222/413 X |
| 4,036,411 | 7/1977 | Westhoff | 222/413 |
| 4,095,625 | 6/1978 | Marpe | 222/152 X |

FOREIGN PATENT DOCUMENTS

| | | | |
|---|---|---|---|
| 520125 | 6/1921 | France | 222/413 |
| 595241 | 2/1978 | Switzerland . | |

*Primary Examiner*—Stephen Marcus
*Assistant Examiner*—Mark Thronson
*Attorney, Agent, or Firm*—Spencer & Frank

[57] ABSTRACT

An apparatus for metering bulk material includes a downwardly open supply chute; a metering screw having an intake length portion for receiving bulk material from the supply chute; a motor operatively connected to the metering screw for imparting rotation thereto; and a tubular metering screw casing accommodating the metering screw and arranged for guiding therein the bulk material advanced by the metering screw during rotation thereof. The metering screw is oriented obliquely with respect to the horizontal. There is further provided a spout supported at the discharge end of the metering screw and arranged for receiving the bulk material advanced thereby. The spout has a downwardly curving configuration and a substantially vertically downwardly oriented outlet opening.

8 Claims, 1 Drawing Figure

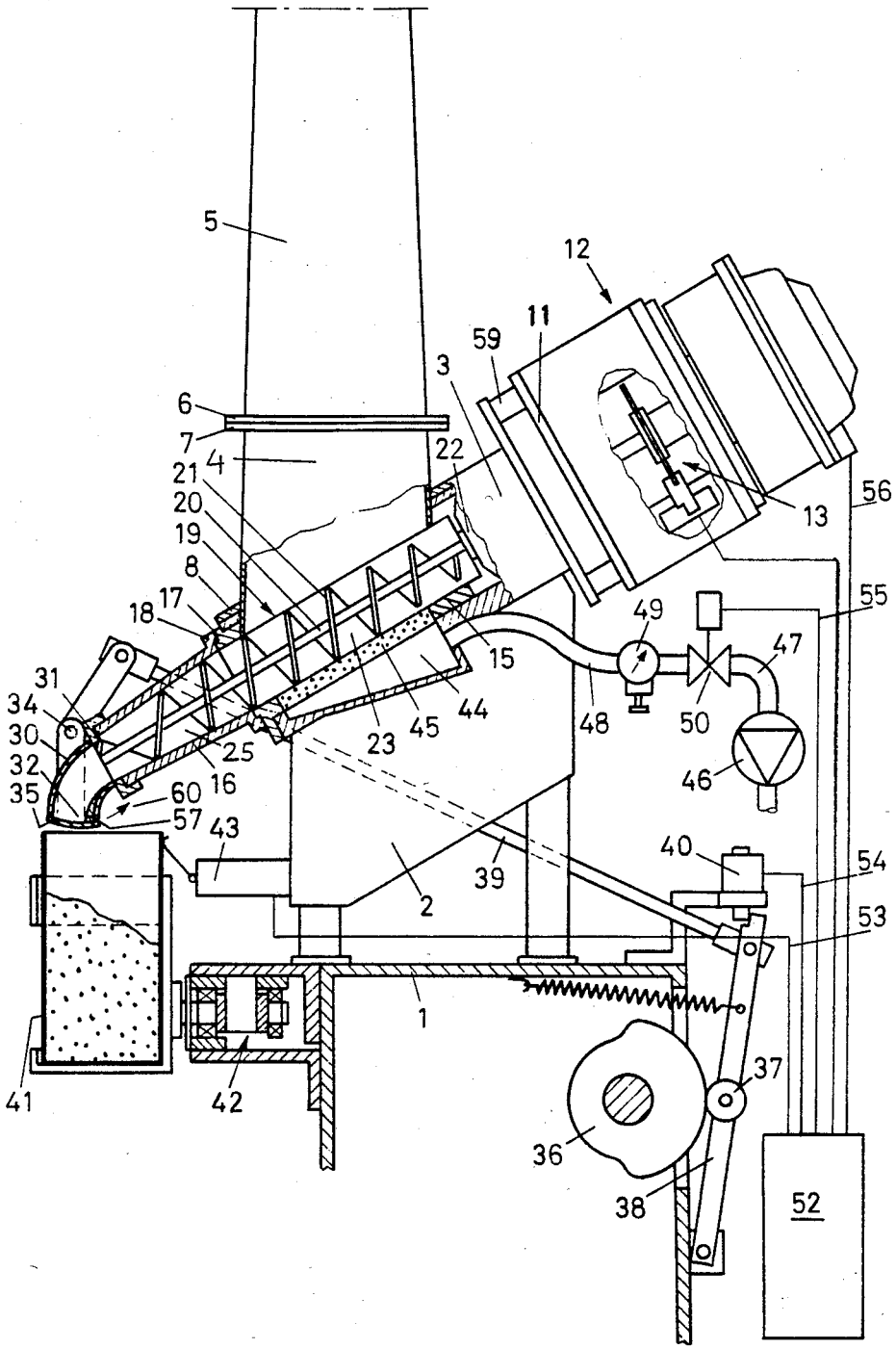
5
12
11
59
3
6
7
4
22
21
20
19
8
17
18
13
56
55
49
47
15
31
34
30
32
35
25
16
60
57
23
45
44
48
50
46
43
40
54
39
2
53
1
41
42
37
36
38
52

APPARATUS FOR METERING BULK MATERIAL

BACKGROUND OF THE INVENTION

This invention relates to a metering apparatus for bulk (flowable) material and is of the type having a motor-driven metering screw which, in each operational (metering and filling) cycle, advances material from a downwardly open chute into a package to be filled.

Metering apparatuses of the above type must meet stringent requirements concerning accuracy of metering and operational speed. It is of primary importance to ensure that the specific volume of the material does not change in an uncontrolled manner. The specific volume is significantly affected in the metering apparatus by the air content and by forces to which the material is exposed during operation, such as sudden directional changes, accelerations and decelerations.

Swiss Pat. No. 595,241 discloses a metering apparatus which includes a stirring mechanism for enhancing the flow of the material to the metering screw. It was found that the stirring device may, by mechanical effects, adversely influence the homogenous consistency of delicate bulk material such as flour. In the apparatus disclosed in the above-named Swiss patent, the material flow is directed into the packages by means of a vertically downwardly oriented metering screw. The latter imparts a rotary motion on the material, as a result of which the material stream exiting at the outlet opening has a downwardly increasing cross-sectional area. In lightweight products, in addition, significant dust generation occurs which, in particular, adversely affects the sealing of the packages.

SUMMARY OF THE INVENTION

It is an object of the invention to provide an improved metering apparatus of the above-outlined type from which the discussed disadvantages are eliminated and with which accurate material quantities may be introduced into open packages in rapid sequence and with a minimum of dust generation.

This object and others to become apparent as the specification progresses, are accomplished by the invention, according to which, briefly stated, the metering screw has, as viewed in the direction of material advance, a downward inclination and, at the forward (discharge) end of the metering screw, there is provided a downwardly curving spout which directs the material generally vertically downwardly into the package.

BRIEF DESCRIPTION OF THE DRAWING

The sole FIGURE, is a schematic elevational view, partially in section, of a preferred embodiment of the invention.

DESCRIPTION OF THE PREFERRED EMBODIMENT

Turning now to the FIGURE a housing 3 is mounted on a machine frame 1 by a carrier structure 2. The housing 3 supports, by means of flanges 6, 7 and 8, a vertical supply chute 5 terminating in a feeding hopper 4. To the upper end of the housing 3 there is secured, by means of spacers 59, a further housing 11 which accommodates a drive motor 12 and an angular position sensor 13. The housing 3 further carries, by means of flanges 17 and 18, a cylindrical metering screw casing 15 and, as a continuation thereof, a conical metering screw casing 16. A metering screw 19 is accommodated in the casings 15 and 16. The casings 15 and 16 and the metering screw 19 disposed therein have a downward inclination of 15° to 45° to the horizontal in the direction of material feed.

The metering screw 19 has a shaft 20 to which there is affixed an auger 21 and which is connected to the drive motor 12 by means of an externally actuated clutch 22. That length portion of the metering screw 19 which is situated immediately underneath the feed hopper 4 is designated as the screw intake 23. Along the screw intake 23 the auger 21 has a constant pitch and a forwardly increasing external diameter, as viewed in the direction of material advance. The diametral change is so designed that the material volume received by the metering screw 19 from the feed hopper 4 is uniformly distributed over the entire screw intake 23.

That length portion of the metering screw 19 which is situated in the conical screw casing 16 is designated as an acceleration zone 25. In the acceleration zone 25 the auger 21 has an increasing pitch and a decreasing diameter as viewed in the direction of material feed. The auger 21 is so constructed in the acceleration zone 25 that a material volume, bounded by the shaft 20 of the metering screw 19, two consecutive windings of the auger 21 as well as an imaginary conical surface surrounding the metering screw is constant in the entire acceleration zone 25.

At the outlet end of the conical screw casing 16 there is mounted a downwardly curving spout 30 by means of a flange 31. The vertically downwardly oriented outlet opening 32 of the spout 30 may be opened and closed by means of a gate 35 which is pivotal about a horizontal pin 34. In the spout 30 there is secured a wedge-shaped filler component 7 which, as viewed in the direction of material flow, effects a gradual reduction of the flow passage cross section of the spout 30. The reduction of the flow passage cross section is coordinated with the properties of the material and the filling speed and is approximately between 2 and 10%. The gate 35 is actuated in a known manner by means of a driven cam disc 36 with the intermediary of a follower roller 37 carried on a pivotally supported lever 38 as well as a push rod 39. A blocking solenoid 40 overrides the cam control and thus ensures in a known manner that the gate 35 remains in the closed position if a sensor 43 reports the absence of an empty box 41 under the spout 30 on the box conveyor 42.

Underneath the screw intake 23 of the metering screw 19 there is situated a vacuum chamber 44 which is separated by a sieve 45 from the cylindrical screw chamber defined by the casing 15. A vacuum pump 46 maintains a predetermined settable vacuum in the vacuum chamber 44 by means of conduits 47 and 48 and a manually operable regulator 49.

The vacuum pump 46 may be operatively connected to, or disconnected from the vacuum chamber 44 by a solenoid valve 50 in order to avoid an excessive compression of the material and thus an excessive initial torque on the motor 12 during a standstill of the metering screw 19. For example, upon withdrawing the armature of the blocking solenoid 40, the vacuum is rendered effective and, upon termination of the filling cycle, when the blocking solenoid 40 is actuated, the vacuum is interrupted in the chamber 44 by an appropriate setting of the solenoid valve 50.

The solenoid valve 50 is controlled by an electric control apparatus 52 in such a manner that the operating vacuum pump 46 is coupled to or cut off from the chamber 44 simultaneously with the energization and, respectively, de-energization of the motor 12. The regulator valve 49, instead of being manually operable, may also be controlled by the control apparatus 52 and may even be incorporated in the valve 50 for an electromagnetic or electronic control. Further, the vacuum may be regulated in such a manner as a function of the motor load that the vacuum is increased if the motor load is reduced and conversely, the vacuum is reduced upon increase of the motor load. As a regulating magnitude, the current consumed by the motor 12 or any other parameter which is proportional to the motor load may be used.

The material to be filled into packages is introduced in the supply chute 5 by a material conveyor (not shown) and the fill level therein is maintained constant by a device known by itself. In the supply chute 5 and the adjoining hopper 4 which have a downwardly increasing cross-sectional area and rounded edges, the material column moves downwardly with a minimum friction.

In the description which follows, the operation of the above-described apparatus will be set forth.

As soon as an empty container 41 is positioned underneath the spout 30 by the conveyor 42, the sensor 43 transmits a corresponding signal to the control device 52 by means of a conductor 53 whereby a filling cycle begins. The control device 52 energizes the blocking solenoid 40 and the vacuum control solenoid valve 50 via conductors 54 and 55, whereby the device 40 is retracted to free the bar 38 and the vacuum pump 46 is connected with the vacuum chamber 44. Thereafter, the cam disc 36 causes the gate 35 to be pivoted away from the opening 32 of the spout 30 in the direction of the arrow 60 and, simultaneously, the drive motor 12 is supplied with current via the conductor 56.

The motor 12, with the intermediary of the clutch 22, drives the metering screw 19 which, aided by the vacuum in the vacuum chamber 44, receives evenly distributed material in the screw intake 23. By virtue of the uniform intake of the material the flow velocity in the feed hopper 4 and the supply chute 5 is distributed over the entire cross section uniformly and thus an inner friction in the material is significantly reduced. It is an important advantage of this arrangement that the tendency for bridge formation in the material is substantially reduced. By virtue of the constant supply of material, the design of the metering screw 19 as well as the use of the vacuum chamber 44, the extent to which the metering screw 19 is filled and the specific volume of the material are maintained constant to a high degree.

Thereafter, the material received by the metering screw 19 is advanced thereby to the acceleration zone 25 where the material flow is constricted to such an extent that the exiting material stream can be directed into a package container 41 situated below the spout 30. The material stream enters the spout 30 with an increased velocity corresponding to the cross-sectional reduction in the acceleration zone 25 and is deflected therein to assume an at least approximately vertically downwardly oriented flow direction. It has been unexpectedly found that by virtue of the reorientation (deflection) of the material, a rotary motion thereof, imparted normally by the metering screw 19, is substantially eliminated.

The metering screw 19, for adapting it to different materials, may be shifted in the direction of its longitudinal axis by lengthening or shortening the spacer members 59. By virtue of the deflection of the material in the spout 30, the material stream is slightly flattened at its inner side. Thus, in that location a void space appears, together with a risk that air is entrained by the material. Such an occurrence would lead to an increased dust generation. In order to avoid such dust generation, in the spout 30 there is arranged an exchangeable insert 57 adapted to the outlet cross-sectional configuration of the material stream.

The compact material stream discharged by the spout 30 is directed approximately vertically into the package container 41. Preferably, the material stream is introduced into the package container 41 along a narrow side thereof in such a manner that a large opening remains free for providing an exit of air from the package container 41, driven out by the inflowing material. In this manner it is ensured that the exiting air stirs up as little dust as possible.

The number of revolutions of the metering screw 19 during one filling cycle is continuously recorded by the angular position sensor 13 and electric signals representing such count are applied to the electric control apparatus 52. The received signals are compared in the control apparatus 52 with a predetermined value and the motor 12 is controlled in such a manner that the metering screw 19 executes the predetermined number of revolutions.

Upon de-energization of the motor 12 the solenoid valve 50 is de-energized, whereby the vacuum is cut off from the vacuum chamber 44. The cam disc 36 causes pivotal motion of the gate 35 into its closed position and the device 40, by virtue of its de-energization, blocks the gate 35 until the start of the consecutive filling cycle. After a new, empty package container 41 is in the filling position, the abovedescribed cycle is repeated. In case of filling delicate material such as flour, the intensity of the vacuum may be varied additionally as a function of the motor load.

It will be understood that the above description of the present invention is susceptible to various modifications, changes and adaptations, and the same are intended to be comprehended within the meaning and range of equivalents of the appended claims.

What is claimed is:

1. In an apparatus for metering bulk material, including a downwardly open supply chute; a metering screw having an intake length portion for receiving bulk material from said supply chute and further having a discharge end; said metering screw being arranged for advancing the bulk material towards said discharge end; a motor operatively connected to said metering screw for imparting rotation thereto; and a tubular metering screw casing accommodating said metering screw and arranged for guiding therein the bulk material advanced by said metering screw during rotation thereof; the improvement wherein said metering screw is oriented obliquely with respect to the horizontal; the improvement further comprising a spout supported at said discharge end of said metering screw and being arranged for receiving the bulk material advanced thereby; said spout having a downwardly curving configuration and a substantially vertically downwardly oriented outlet opening; means defining a vacuum chamber situated underneath said intake length portion, a sieve separating said vacuum chamber from said intake length portion, a vacuum source, a conduit connecting said vacuum source to said vacuum chamber; valve means in said conduit for operatively connecting said vacuum source to and disconnecting it from said vacuum chamber and for maintaining a set vacuum constant in said vacuum chamber; and means for regulating the vacuum in said vacuum chamber by controlling said valve means as function of a variable representing a load on said motor.

2. In an apparatus for metering bulk material, including a downwardly open supply chute; a metering screw having an intake length portion for receiving bulk material from said supply chute and further having a discharge end; said metering screw being arranged for advancing the bulk material towards said discharge end; a motor operatively connected to said metering screw for imparting rotation thereto; and a tubular metering screw casing accommodating said metering screw and arranged for guiding therein the bulk material advanced by said metering screw during rotation thereof; the improvement wherein said metering screw is oriented obliquely with respect to the horizontal; wherein said metering screw has, along said intake length portion, a constant screw pitch and a screw diameter increasing in the direction of material feed in said metering screw casing for receiving bulk material from said supply chute in a uniform distribution along the entire said intake length portion; wherein said metering screw has an acceleration length portion and wherein said metering screw has, along said acceleration length portion viewed in a direction of material feed, an increasing screw pitch and a decreasing screw diameter coordinated with one another such as to maintain constant a volume bounded by any two consecutive turns of the metering screw and by an imaginary surface circumscribable about said metering screw; wherein said metering screw casing comprises consecutive first and second portions as viewed in the direction of material advance in said metering screw casing; said first portion having a cylindrical screw chamber and said second portion having a conical screw chamber narrowing in the direction of material advance; the improvement further comprising a spout supported at said discharge end of said metering screw and being arranged for receiving the bulk material advanced thereby; said spout having a downwardly curving configuration and a substantially vertically downwardly oriented outlet opening; said spout defining a curved flow passage having a cross-sectional area; an insert mounted in said spout; said insert including shaped means for effecting that material flow in said spout fully fills the cross-sectional area along said curved flow passage; means defining a vacuum chamber situated immediately underneath said intake length portion, a sieve separating said vacuum chamber from said intake length portion, a vacuum source and a conduit connecting said vacuum source to said vacuum chamber.

3. An apparatus as defined in claim 2, wherein said metering screw is inclined to the horizontal at an angle of between 15° and 45°.

4. An apparatus as defined in claim 2, further comprising means for varying an axial position of said metering screw.

5. An apparatus as defined in claim 2, further comprising a movably supported gate arranged for opening and closing said outlet opening.

6. An apparatus as defined in claim 2, further comprising valve means in said conduit for operatively connecting said vacuum source to and disconnecting it from said vacuum chamber and for maintaining a set vacuum constant in said vacuum chamber.

7. An apparatus as defined in claim 6, further comprising a control apparatus means connected to said valve means and said motor for energizing and de-energizing said valve means for maintaining a vacuum in said vacuum chamber solely during rotation of said metering screw.

8. An apparatus as defined in claim 2, further comprising conveyor means for sequentially positioning containers underneath said spout to be filled by metered bulk material; said conveyor means being so positioned with respect to said outlet opening of said spout that the containers are eccentrically located with respect to said outlet opening of said spout during filling with metered bulk material.

* * * * *